US010022596B2

(12) United States Patent
Park

(10) Patent No.: US 10,022,596 B2
(45) Date of Patent: Jul. 17, 2018

(54) SIDE SWING PUTTER

(71) Applicant: Kwang-Young Park, Yongin-si (KR)

(72) Inventor: Kwang-Young Park, Yongin-si (KR)

( * ) Notice: Subject to any disclaimer, the term of this patent is extended or adjusted under 35 U.S.C. 154(b) by 0 days.

(21) Appl. No.: 15/110,496

(22) PCT Filed: Oct. 14, 2014

(86) PCT No.: PCT/KR2014/009643
§ 371 (c)(1),
(2) Date: Jul. 8, 2016

(87) PCT Pub. No.: WO2015/111822
PCT Pub. Date: Jul. 30, 2015

(65) Prior Publication Data

US 2016/0332037 A1 Nov. 17, 2016

(30) Foreign Application Priority Data

Jan. 21, 2014 (KR) ..... 10-2014-0007114
Oct. 8, 2014 (KR) ..... 10-2014-0135695

(51) Int. Cl.
*A63B 53/14* (2015.01)
*A63B 53/00* (2015.01)
(Continued)

(52) U.S. Cl.
CPC ..... *A63B 53/007* (2013.01); *A63B 53/0487* (2013.01); *A63B 53/10* (2013.01);
(Continued)

(58) Field of Classification Search
CPC ..... A63B 53/007; A63B 60/20; A63B 53/10; A63B 53/0487; A63B 60/12; A63B 53/14;
(Continued)

(56) References Cited

U.S. PATENT DOCUMENTS 4,960,279 A * 10/1990 Harris, Jr. ..... A63B 53/0487 473/251
5,228,695 A * 7/1993 Meyer ..... A63B 53/00 473/238
(Continued)

FOREIGN PATENT DOCUMENTS

JP 2002-306648 A 10/2002
JP 2004-187995 A 7/2004
(Continued)

OTHER PUBLICATIONS

Communications of Office Action dated Jan. 26, 2018 of Chinese Patent Application No. 201480073709.2, which corresponds to this application.

*Primary Examiner* — Stephen Blau
(74) *Attorney, Agent, or Firm* — Goldilocks Zone IP Law

(57) ABSTRACT

Provided is a putter in golf clubs for use in swinging and putting beside a golf ball while looking at front and keep watching the moving trace of the golf ball, which is titled as a look & watching side swing putter by which a golfer stands at the same point of place where he examined the green grass state and the distance previously, and practices swings while checking the estimated imaginary putting line of the golf ball, and executes putting of the golf ball on the side thereof like bowling while keep watching the golf ball, thereby reducing the putting errors or strokes to wrong directions due to the differences in views direction depending on putting posture and improving straight-line movement of the golf ball at putting.

12 Claims, 24 Drawing Sheets

(51) Int. Cl.

| | |
|---|---|
| ***A63B 53/10*** | (2015.01) |
| ***A63B 60/12*** | (2015.01) |
| ***A63B 60/20*** | (2015.01) |
| *A63B 53/04* | (2015.01) |
| *A63B 71/06* | (2006.01) |
| *A63B 60/34* | (2015.01) |
| *A63B 60/02* | (2015.01) |

(52) U.S. Cl.
CPC ..... *A63B 53/14* (2013.01); *A63B 60/12* (2015.10); *A63B 60/20* (2015.10); *A63B 60/02* (2015.10); *A63B 60/34* (2015.10); *A63B 2053/0408* (2013.01); *A63B 2053/0433* (2013.01); *A63B 2053/0441* (2013.01); *A63B 2053/0445* (2013.01); *A63B 2053/0491* (2013.01); *A63B 2071/0694* (2013.01); *A63B 2210/50* (2013.01)

(58) Field of Classification Search
CPC .... A63B 2053/0445; A63B 2071/0694; A63B 2210/0694; A63B 2210/50; A63B 2053/0433; A63B 2053/0408; A63B 2053/0491; A63B 2053/0441; A63B 60/34; A63B 60/02
See application file for complete search history.

(56) References Cited

U.S. PATENT DOCUMENTS 5,344,149 A * 9/1994 Miller ..... A63B 53/0487 473/340
5,690,556 A * 11/1997 Condon ..... A63B 53/04 473/252
5,776,006 A * 7/1998 Gruber ..... A63B 69/3638 403/344
5,830,081 A * 11/1998 Kitahara ..... A63B 53/14 473/203
5,893,804 A * 4/1999 Pan ..... A63B 53/04 473/240
5,976,025 A * 11/1999 Williams ..... A63B 53/0487 473/252
7,066,829 B1 * 6/2006 Lister ..... A63B 53/007 473/313
7,101,288 B2 * 9/2006 Thomas ..... A63B 69/3685 273/DIG. 14
9,044,655 B1 * 6/2015 Hanson ..... A63B 53/0487
9,227,116 B2 * 1/2016 Cynn ..... A63B 53/04
2004/0166956 A1 * 8/2004 Shioda ..... A63B 53/007 473/294
2006/0199663 A1 * 9/2006 Lister ..... A63B 53/007 473/340
2007/0298904 A1 * 12/2007 Dworzan ..... A63B 53/02 473/340
2013/0017902 A1 * 1/2013 Cheng ..... A63B 53/10 473/319

FOREIGN PATENT DOCUMENTS

| | | | |
|---|---|---|---|
| JP | 2004-255179 | A | 9/2004 |
| JP | 2005-144082 | A | 6/2005 |
| JP | 2010-201090 | A | 9/2010 |
| KR | 1019980014727 | A | 5/1998 |
| KR | 20-0374723 | Y1 | 2/2005 |
| KR | 20-2010-0002951 | U | 3/2010 |
| KR | 10-2012-0031856 | A | 4/2012 |
| KR | 10-1254463 | B1 | 4/2013 |

* cited by examiner

SIDE SWING PUTTER

CROSS-REFERENCE TO RELATED APPLICATION

This application claims priority under 35 U.S.C. § 119 to Korean Patent Application Nos. 10-2014-0007114 filed on Jan. 21, 2014 and 10-2014-0135695 filed on Oct. 8, 2014, the disclosure of which is hereby incorporated by reference in its entirety.

BACKGROUND

1. Field

The present invention relates to a golf putter among various types of golf clubs for use in playing a golf and, more particularly, to a golf putter for enhancing the rolling straightness of a golf ball directed toward a hole and increasing the accuracy of putting by minimizing the errors and the mistakes in putting and by modifying the hitting surface shape of the putter head. In a typical way of putting until now, a golfer examines the green state and the distance before putting and determines the estimated trace of a golf ball. However, in real putting, the golfer stands looking at the golf ball and turns his face sideway unlike the observation posture that the golfer examined, and bows to the golf ball direction with his waist bent and his eyes turned sideway toward a hole. Then, he putts a golf ball finally depending only on his training experiences and his sense of views while still with the fears and uneasiness from the putting views changed from the observation views and the high possibility in errors raised from the differences between his observation and real putting in views and postures. Therefore, the present invention is directed to provide a golf putter by the configuration of which a golfer can practice swing and set up his posture for putting as the same way as he looked up the target hole at front and watched the estimated trace of the golf ball, and then still stands up beside the golf ball and putts the golf ball just like bowling while keep looking at the golf ball.

2. Description of Related Art

Generally, a swing putter 100 of a golf club includes a grip 101, a shaft 102, and a head 103 as shown in FIG. 1. While a golfer plays a golf and when uses a putter, he is positioned to stand up perpendicularly to the line that the putter moves and the hit ball proceeds which is a putting line, and bend down his waist, lower his or her both arms down, holds the grip 101 of the swing putter 100 and swings the putter left and right and putts the golf ball with the head 103.

As shown in FIG. 2, a golfer executes In-In swing with respect to the center line (L1) of his spine. This is because the circular motion with respect to the spine central line (L1) as axis is natural to follow by the law of nature. Depending on how much are the angle (θ1) that the golfer bows, the angle of his arms (θ2) to the spine central line (L1) and the angle of his views (θ3) that his eyes looks at the golf ball, the traces of golf ball movement, that is, each trace that the golf ball proceeds and travels brings different result.

A golfer generally swings for putting at standard position with respect to the spine central line (L1) while focusing and maintaining the angles (θ1, θ2 and θ3) as shown in FIG. 2. Then, the path for the golf ball 200 to proceed should be the way (T1) as shown in FIG. 3. However, the moving direction of the golf ball 200 in real putting result may be turned to a second direction (T2) as shown in FIG. 3 due to the golfer's body structural feature and his In-In swing as normal. Or, in the case of correcting and adjusting his swing excessively, the moving direction of the golf ball 200 in real swing and putting may be a third direction (T3) as shown in FIG. 3 as the Out-Out swing or Neutral-Out swing.

Generally, golfers practice the swing putting times out of number with putting a straight-shaped iron bar with a predetermined width on stroke area in order to prevent the golf ball 200 from proceeding toward the second (T2) or the third direction (T3), and to make the golf ball 200 proceed straightly along the first direction (T1), and to increase the repeatability. Another stance of the golfer to swing the putter is shown in FIGS. 4 and 5, in which he stands and bows and bends his waist and his arms at right angle (90°) with respect to his spine central line (L1) and he always swings and putts in the same angles and the same length while maintaining the angles of his waist and his arms ninety degrees (θ4=θ5=90°) and keeping the views angle of the golfer (θ6) acute angle. Thus, it was intended to decrease the errors which may depend on mentally and physically different condition. In some case, a long putter (belly putter) may be used as shown in FIGS. 6 and 7 in such way that the top portion of a grip 101 of a putter 100 is fixed to the belly or chest (B1) of a golfer.

As shown in FIGS. 8 and 9, a golfer examines in many directions in order to find out the exact track path reached from a golf ball 200 to a hole in advance before putting. In this step, the golfer may hunker down beside a golf ball, or bend his body, or even lay his face down on the green in order to precisely examine and estimate the track path of the golf ball to the target point (A1). These positions are all proceeding with both two eyes facing at front toward the direction to be examined and seeing the direction of the target hole horizontally.

Meanwhile, when the golfer determines the putting line, and he sets up his body line (L2) for putting, and he finally checks the estimated track path of the golf ball to the target point (A1) finally, it is now that he already bows and his body is bent down (θ1≠θ2≠θ3≠90° in FIG. 2) and he looks at the target point (A1) with turning his face sideway which is shown in FIGS. 10 and 11. With his body bent forward with his eyes views downward at the golf ball and his spine central line angled between them, he has to turn his face sideway as much as 90° so that he results in seeing the target point (A1) in completely different views from initially he examined and estimated the track path of the golf ball. In the instant moment like this, the golfer may be dismayed momentarily as result that he could not find out the target point (A1) or the estimated track path exactly, or he may be confused to make him lose his confidence, which thus results in wrong putting swing. Therefore, the mistakes in swinging and putting bring the problems that the golf ball 200 may be proceeded in the direction (T2 or T3) as shown in FIG. 3.

As shown in FIG. 12, when a golfer swings and putts a golf ball, he hits the golf ball without rolling the ball. Thus, the golf ball 200 slips with no rotation in the first region S1 by the skid phenomenon, and then, rolls in the second region S2. Sometimes, the golf ball may be proceeded to a wrong direction even in the first region S1. Or, the direction and the distance of the golf ball 200 in the second region S2 may be determined depending on the state of the green condition at the interface of the first and second regions S1 and S2. Therefore, the distance to be rolled and the direction of the golf ball proceeding are not as good as examined and estimated previously, and sometimes unexpected results happen. This may be the problems in the swing by hitting, but there existed problems in the features of the hitting face of the head of the conventional swing putter 100.

As shown in FIG. 18, the putting surface 103*a* of the head 103 is made to have an angle (θ12) mostly open upward. At putting, the golf ball 200 may bounce from the green grass 300 toward up due to the hitting angle (θ11) of the golf ball. The rolling factor (r1) of the ball according to the swing trace path may be reduced by the hitting angle (θ11) and may be changed to reverse-rolling factor (r2) so as to occur skid phenomenon and bring undesirable results. In order to overcome this problem and correct this fault, a golfer often executed swing by forcibly raising the head 103 upward, but the results just bring the swing errors such as putting to the direction of T2 or T3 in FIG. 3

Further, a normal swing must be executed along the direction (t1) by the conventional swing putter 100 as shown in FIG. 13, but swing and strike out of sweet spot (t2, t3) often occurs. Specifically, many problems and bad results in putting are brought in the putting direction or putting distance because of the errors or mistakes of, such as the angle (θ7) from the strike by In-Out swing shown in FIG. 14, or the angle (θ8) from the strike by Out-In swing shown in FIG. 15, and rather than the hitting direction of the face 103*a* of the head 103 to the golf ball 200 is maintained perpendicular to each other as normal as shown in FIG. 13, the hitting angle (θ9) of the head 103 is closed swing as shown in FIG. 16, or the hitting angle (θ10) of the head 103 is open swing as shown in FIG. 17, and so on.

SUMMARY

Embodiments of the present invention provide a golf putter for use in putting a golf ball enabling a golfer to swing and putt a golf ball by the new posture with the new configuration of the putter while solving and improving the problems of the golf playing by conventional typical putters and changing the structure of the conventional typical putters.

Embodiments of the present invention provide a golf putter enabling a golfer to swing and putt a golfer ball while standing at the same location where he or she examined the green state and the distance to a target hole and estimated the travel trace of the golf ball and imagined his or her putting line, and enabling the golfer to strike the golf ball while he or she can still look at the front and watch the golf ball moving similar to the bowling posture.

Embodiments of the present invention provide a golf putter enabling a golfer to stand on the side of a golf ball, and swing and putt the golf ball while keep looking at the front and watching the putted golf ball, which is named as a look & watching side swing putter (SSP), in short, referred to as SSP. The SSP of the present invention reduces putting errors raised from the putting postures and differences in views by use in conventional typical putters, and decreases the strokes to wrong directions.

Embodiments of the present invention provide a look & watching side swing putter (SSP) for improving the straight-lined movement of the golf ball during putting by decreasing skidding and increasing rolling of the putted golf ball with the putting surface of the putter head being reversely cambered.

Embodiments of the present invention provide a look & watching side swing putter (SSP) for putting a golf ball to roll naturally and smoothly by providing a shaft fixing point attached and fixed to the putter behind the putting surface of a putter head, and for increasing the surface friction of the putter against the golf ball toward its rotation direction at the moment of putting, thus to produce top spin of the golf ball by forming a groove aligned in parallel on the putting surface of the putter head.

Embodiments of the present invention provide a look & watching side swing putter (SSP), which is configured such that the lower edge on the putting surface of the putter head is made round and the above groove of the putting surface of the head is extended to this round-shaped edge in order to reduce putting errors which may occur by hit and impact of the golf ball on the lower corner portion of the head putting surface so that the putted golf ball moves toward wrong direction which is unpredicted and unwanted direction.

Embodiments of the present invention provide a look & watching side swing putter (SSP) for minimizing the errors results from the golf ball strike out of a sweet spot and preventing open or closed club face swing by forming the head such that its center of mass is distributed to both side ends.

Embodiments of the present invention provide a look & watching side swing putter (SSP) for considering the individual variation to the maximum in putting and reducing the errors due to these differences among individuals in order to improve the golf ball movement to straight-lined direction and allow consistent putting in results or posture by forming adjust weights on both side ends of the back portion of the head.

Embodiments of the present invention provide a look & watching side swing putter (SSP) in which a first indicator line and a second indicator line are respectively formed on the top surface of the putter head and the lower portion of the shaft, for two lines being connected to each other, and thus for a golfer to enable check the directional accuracy in his swinging and putting while seeing these two indicator lines moving by his own eyes in training or playing games in order to achieve good reproducibility in the direction.

In accordance with an aspect of the present invention, the look & watching side swing putter may include a second grip a golfer taking a grip on by one hand with his or her palm facing a first target direction; a second shaft located up and down the second grip and having a diameter as small as inserted into the fingers of a golfer without irritating; a first shaft extended up and down from the second shaft; a head provided at the bottom end of the first shaft; and a first grip provided at the top end of the first shaft.

The look & watching side swing putter of the present invention may be configured for a golfer to enable execute putting such that the golfer takes a grip on the second grip by his or her main hand with the palm of the main hand faced toward the direction of the first target and the golfer takes a grip on the first grip by the other hand for swinging back and forth without wavering just like the grip of the conventional typical putter or claw grip, and the golfer enable to stand beside a golf ball and swing the putter back and forth and hit the golf ball by the head of the putter and enable to keep watching the putted ball moving.

The second shaft may be configured to have a diameter in the range of φ5 mm to φ7 mm to be inserted between the index finger and long finger of the golfer's hand or between the long finger and the ring finger when the golfer takes a grip on the second grip having a sphere shape.

The head of the putter may be configured such that the putting surface of the head has reverse camber of a predetermined angle.

The predetermined angle of the reverse camber may be made a reverse-incline angle in the range of 1° to 3° to the vertical line to produce top spin in order to improve the straight-lined direction movement of the golf ball being hit.

The head of the putter may be configured such that the fixing point of the first shaft to the head is located on the back of the putting surface of the head in order to increase an upward vector quantity of the head by pendulum movement, and grooves aligned in parallel are formed on the reverse camber of the putting surface of the head in order to reduce the slip of the golf ball, and in order to produce top spin by increasing the surface friction to the rotation direction of the golf ball.

The bottom edge portion of the putting surface of the head may be made to have round shape in order to prevent the putting error raised by the blow impact of the golf ball being hit to the head, and edge grooves are formed on the round-shaped edge portion of the putting surface of the head by extended from the grooves formed as above.

The head may be made such that its center of mass is bidispersive along the both ends back of the putting surface in order to reduce the errors from the hitting results out of sweet spot and reduce the occurrence of the head distorted at swing.

The head may be configured such that an adjust weight is formed on both back sides of the head in order to adjust the error factors in the right and the left direction raised from individual variation of putting and improve the straight-lined directional movement.

The adjust weight may include weight coupling parts formed on both back sides of the head; and adjust weight members having different weights respectively and being able to be selectively coupled to the weight coupling parts.

A first indicator line may be formed on the top surface of the head along its center line in order to help a golfer visually enable see his or her swinging back and forth accurately along the straight line, and a second indicator line may be formed on the lower portion of the first shaft to be extended from and connected with the first indicator line to secure good visual views.

The head may be configured such that a plurality of blades are formed on the bottom surface of the head along the putting direction in order to reduce the friction with green grass occurred when the head contacts and drags at putting and assist the straight-lined movement of the golf ball after being hit.

The second grip may be made to include: a first stopper formed on the outside surface of one side of the second shaft; a plurality of second stoppers formed on the outside surface of the other side of the second shaft; a first hemisphere grip having a first hole, the first stopper being fitted into, and a plurality of nut insertion coupling holes; a second hemisphere grip having a plurality of second holes, the second stoppers being fitted into, and a plurality of second coupling holes, the second hemisphere grip faced with the first hemisphere grip; and bolts/screws for fixing the first hemisphere grip and the second hemisphere grip to the outer circumference surface of the second shaft to form a spherical shape and coupling the first and second hemisphere grips together.

As described above, the look & watching side swing putter (SSP) of the present invention most of all, allows a golfer to stand looking at a target hole in the front way and enable to putt a golf ball while maintaining the first posture as set for putting, and makes him or her keep watching the putted ball moving along the putting line. Therefore, the SSP of the present invention makes the swinging movement for putting a genuine pendulum movement to further reduce the errors and mistakes which often occurred in the past pendulum movement by the swinging and the putting in unnatural and unstable posture with the conventional typical putter to produce rotation of the golf ball. Further, the SSP of the present invention assures a golfer to execute better putting in more confidence and assurances because the structure of the SSP and the posture for putting reduce golfer's views differences between pre-examining and execution of putting, and resultingly, the differences between his estimated putting line that the golf ball would travel and the real putting result that the putted ball moves come to incredibly narrow, and the errors and the mistakes due to the differences and the disturbance in the past can be further decreased.

Furthermore, a golfer can practice putting and train his swinging with sufficiently securing visual competitive so that he can check his swinging better in direction or not and the reproducibility in direction can be highly increased. The skidding of the putted golf ball is decreased and its rolling is increased. In addition, the side swing putter of the present invention provides the advantages of correcting swing errors raised from golfer's habitual and stubborn swing posture and inducing the strike of the putter to the golf ball at the moment of putting at perpendicular to each other (right angle: 90°).

Particularly, the possibility of mistakenly strike on the lower edge in the past by use of conventional typical putter can be incredibly reduced or eliminated so that the momentary contact time at the hit moment of the golf ball with the head hitting surface of the SSP of the present invention can be extended, and even with minor slight swing mistake occurs, top spin can be produced and straight-lined directional movement can be improved. Furthermore, the resistance which the friction with the green grass may bring due to mistake at swing can be reduced and thus, the golfer can swing along the right direction and the hit golf ball can be proceeded along the straight line.

BRIEF DESCRIPTION OF THE DRAWINGS

The foregoing and other features and advantages of the inventive concepts of the present invention will be apparent from the more particular description of preferred embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings.

DETAILED DESCRIPTION OF THE EMBODIMENTS

Figure 1:
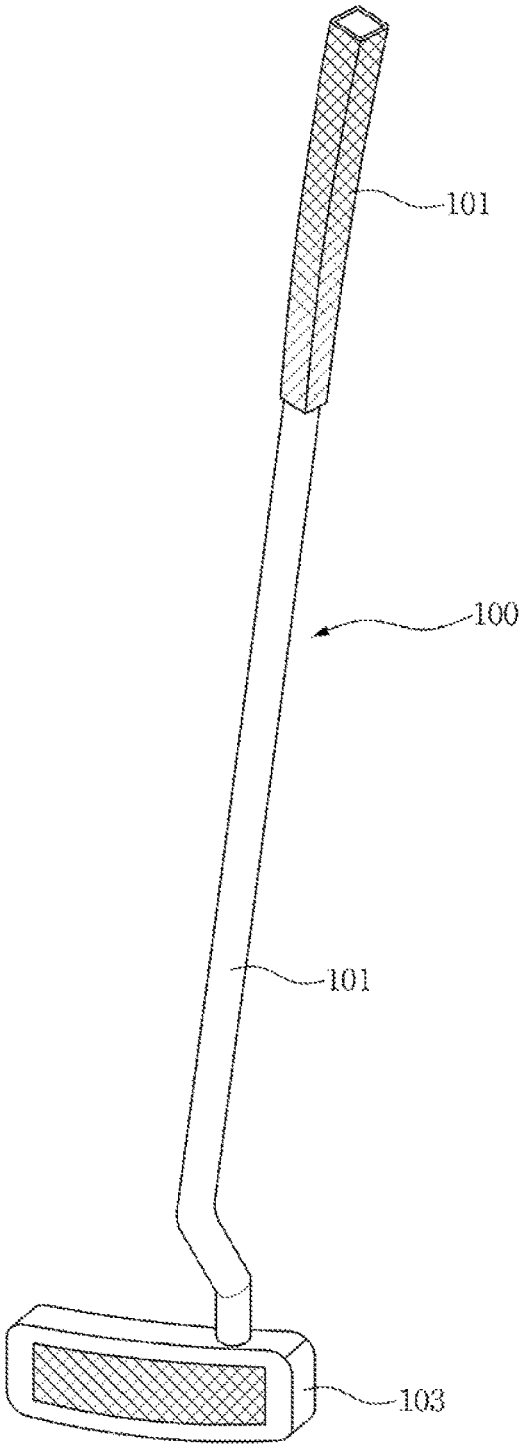
FIG. 1 is a perspective view illustrating the structure of a conventional typical golf putter.
Figure 2:
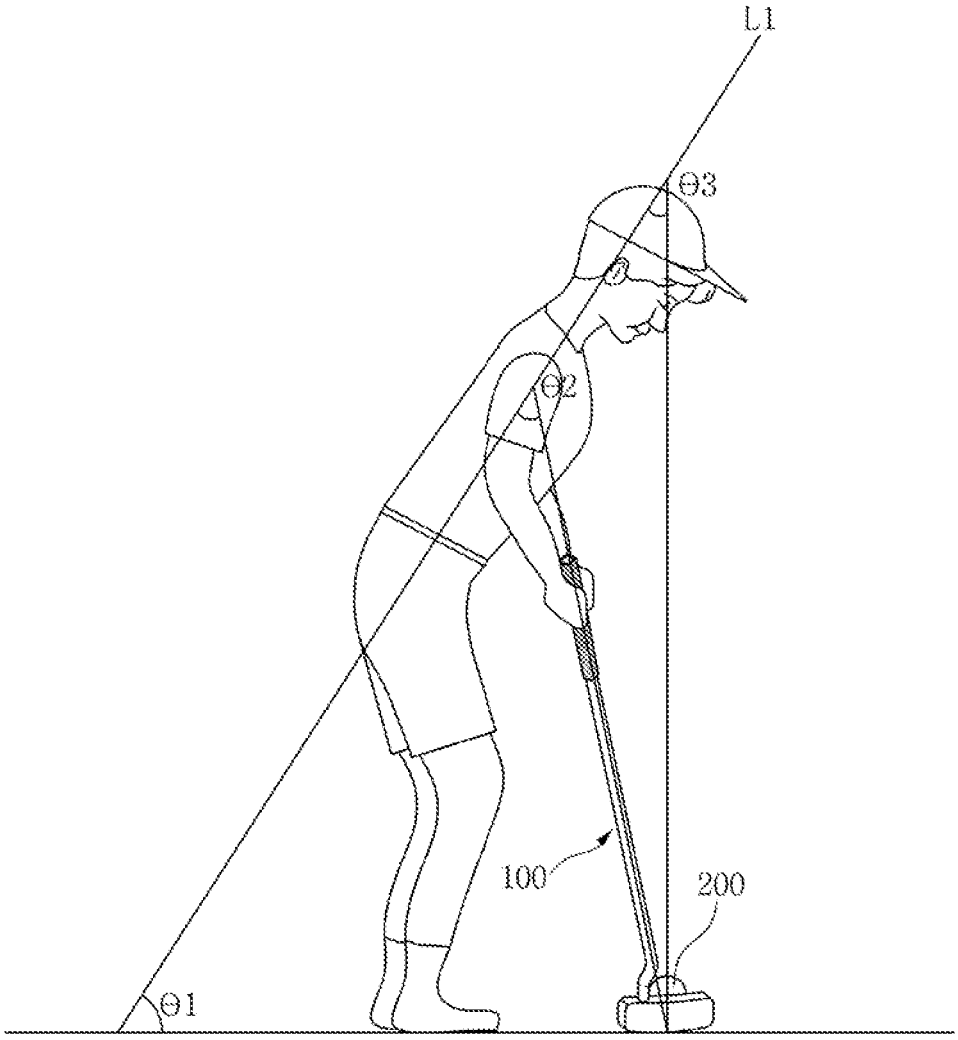
FIG. 2 is a schematic side view illustrating the putting posture that a golfer holds a conventional typical putter.
Figure 3:
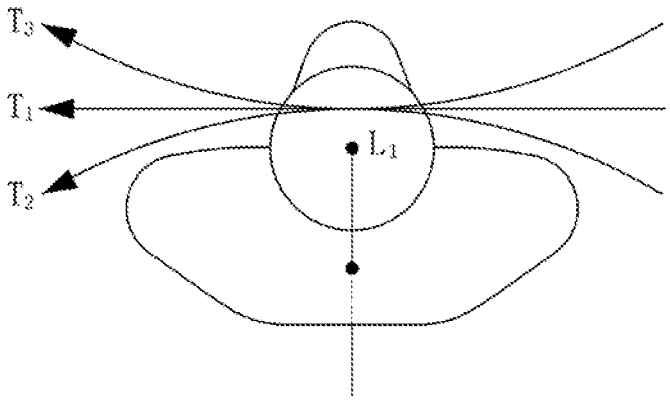
FIG. 3 is a schematic top view illustrating the putting posture by using a conventional typical putter.
Figure 4:
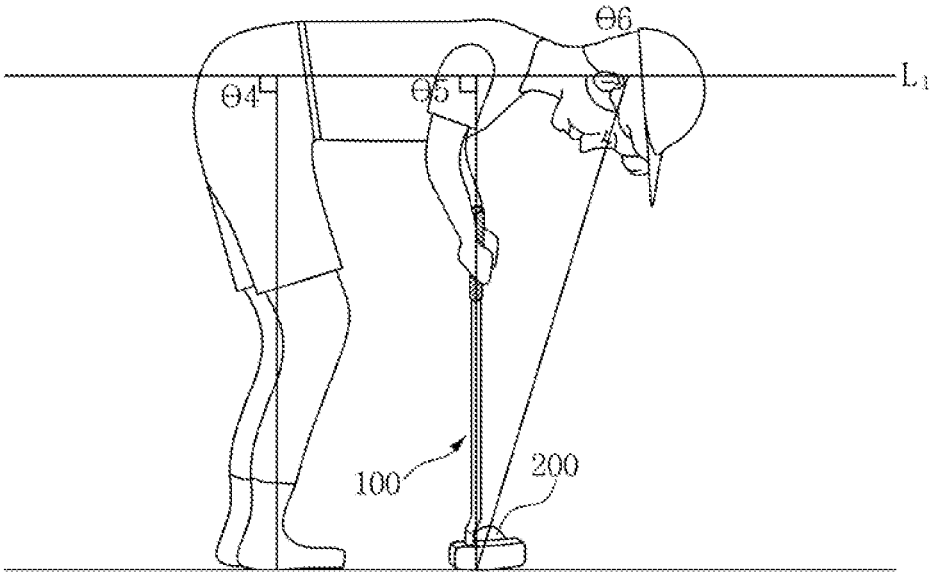
FIG. 4 is a schematic side view illustrating the putting posture for pelvis right angle swing that a golfer holds a conventional typical putter.
Figure 5:
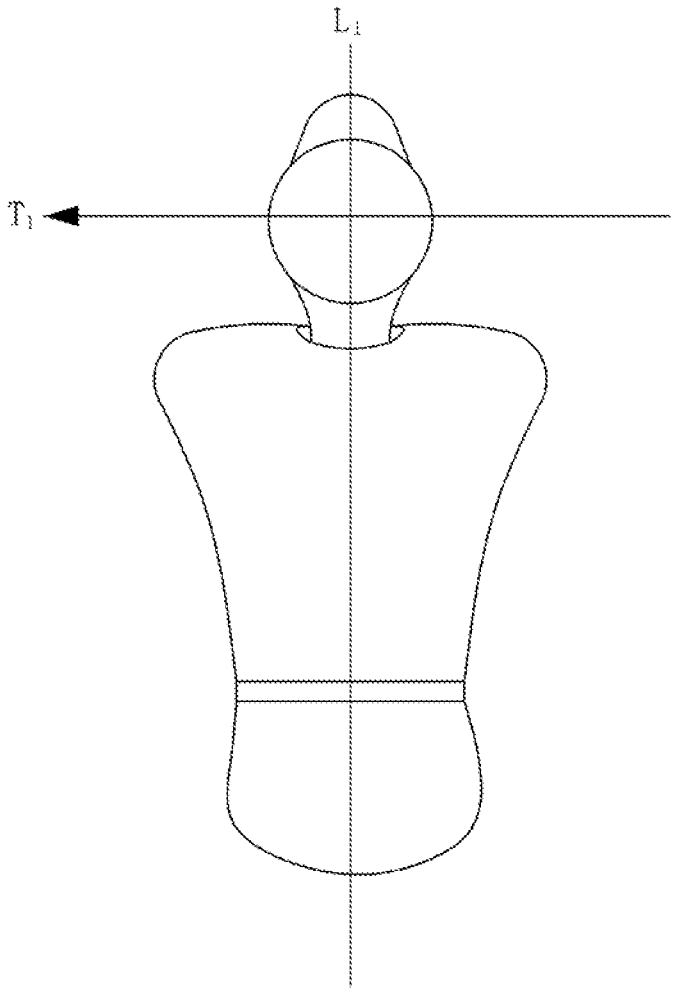
FIG. 5 is a schematic top view illustrating the putting posture for pelvis right angle swing by using a conventional typical putter.
Figure 6:
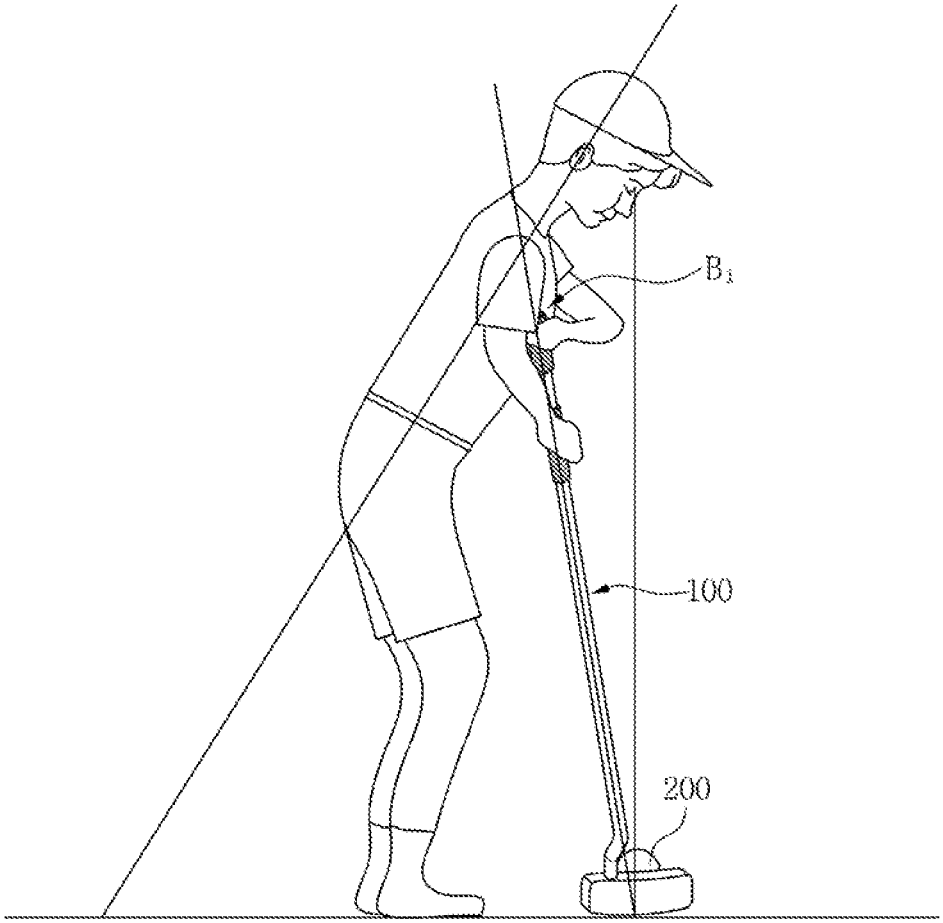
FIG. 6 is a schematic side view illustrating that a golfer is positioning for putting by using a conventional long putter (belly putter)
Figure 7:
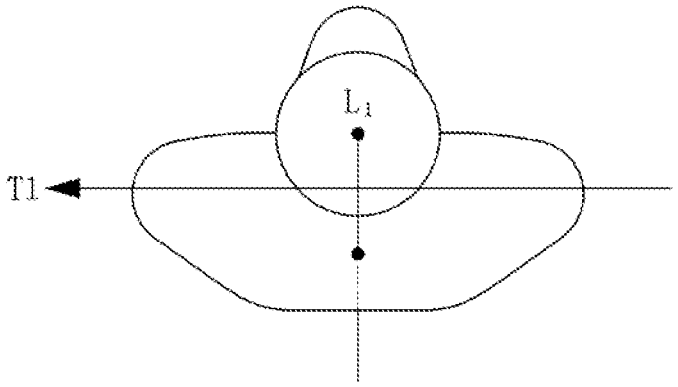
FIG. 7 is a schematic top view illustrating that a golfer is positioning for putting by using a conventional long putter (belly putter)
Figure 8:
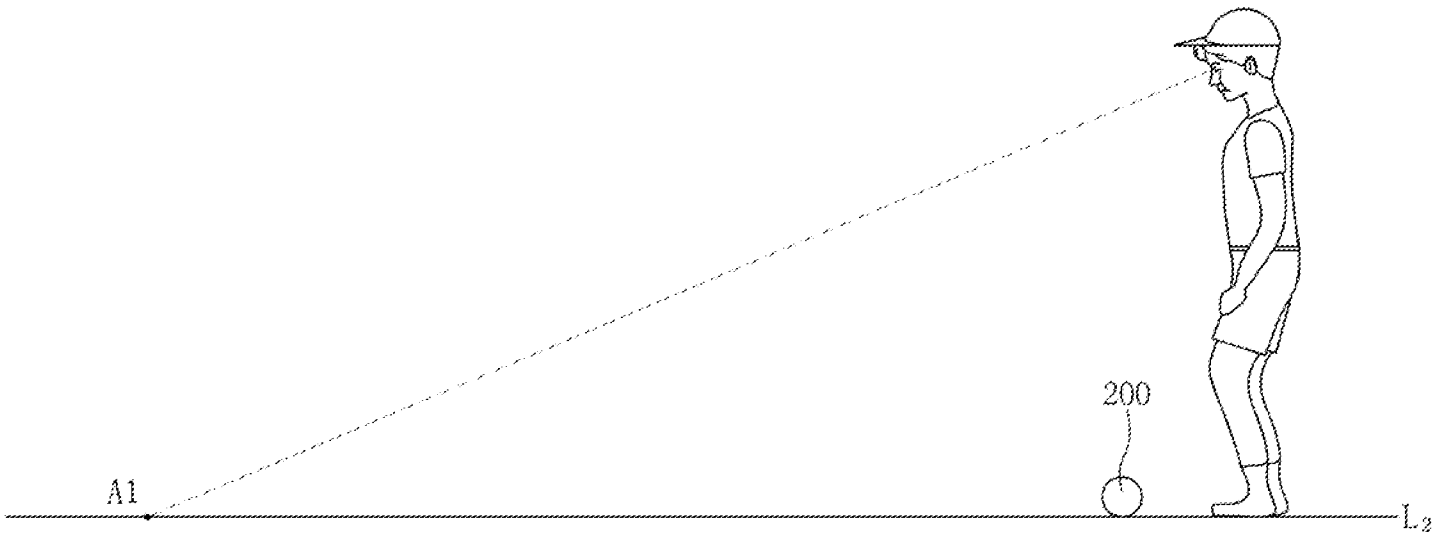
FIG. 8 is a schematic side view illustrating that a golfer is examining the estimated putting line in the use of a typical putter.
Figure 9:
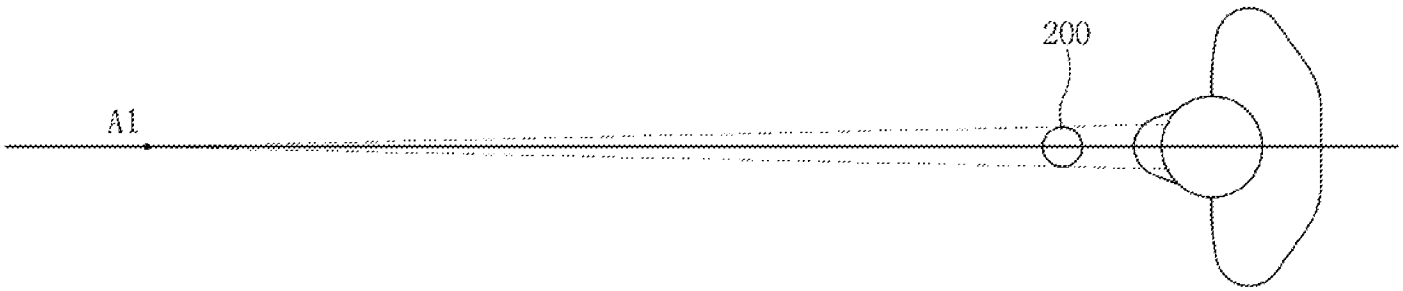
FIG. 9 is a schematic top view illustrating that a golfer is examining the estimated putting line in the use of a typical putter.
Figure 10:
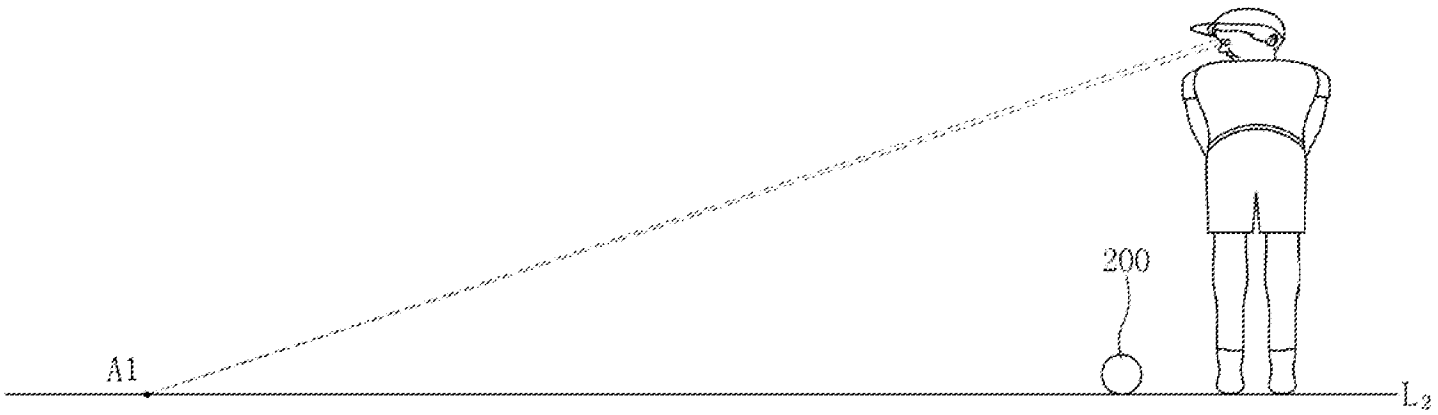
FIG. 10 is a schematic side view illustrating the final determination state that a golfer is looking at the target right before putting in the use of a conventional typical putter.
Figure 11:
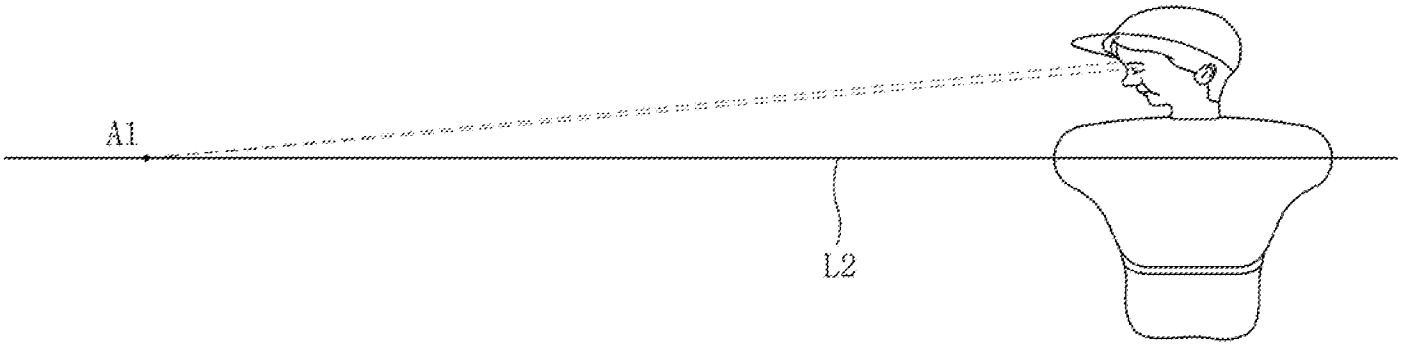
FIG. 11 is a schematic top view illustrating the final determination state that a golfer is looking at the target right before putting in the use of a conventional typical putter.
Figure 12:
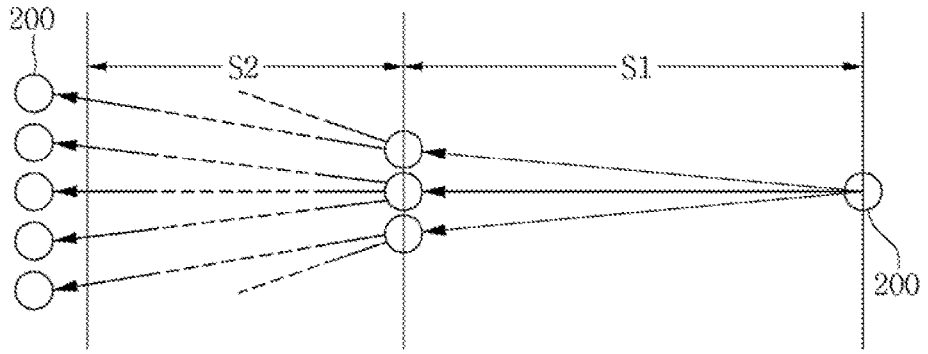
FIG. 12 is a view illustrating the estimated moving traces of the golf ball at occurrence of skidding by putting in the use of a conventional typical putter.
Figure 13:
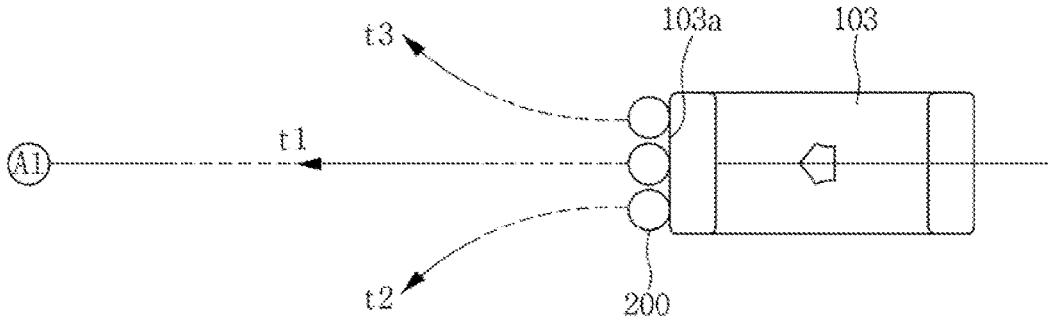
FIG. 13 is a view illustrating the moving traces of the golf ball at normal swing by use of a conventional typical putter.
Figure 14:
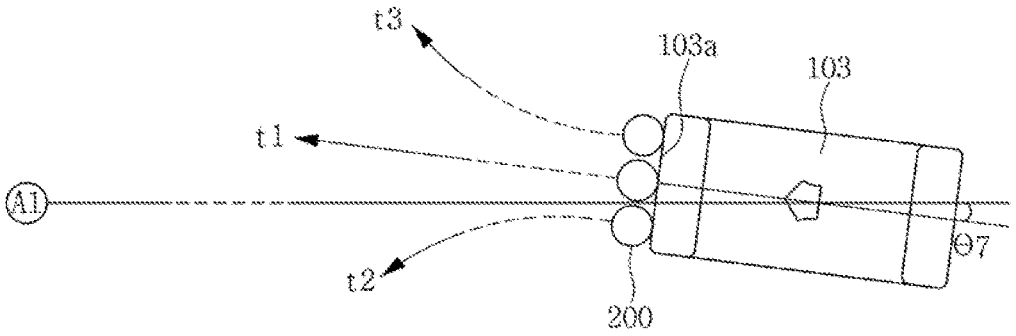
FIG. 14 is a view illustrating the moving traces of the golf ball at In-Out swing by use of a conventional typical putter.
Figure 15:
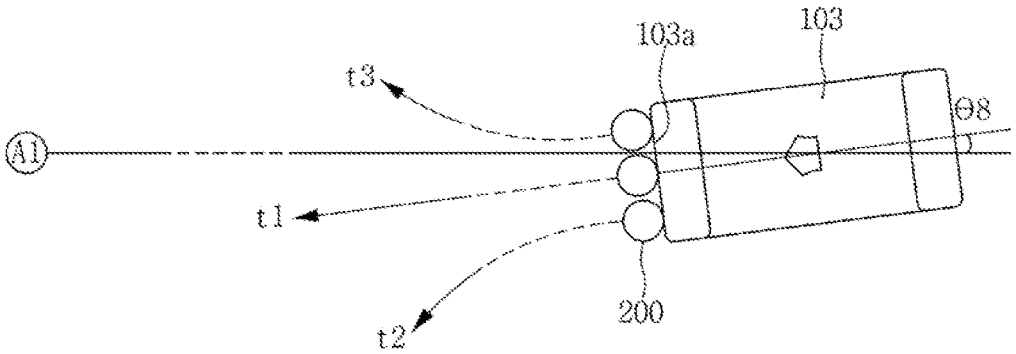
FIG. 15 is a view illustrating the moving traces of the golf ball at Out-In swing by use of a conventional typical putter.
Figure 16:
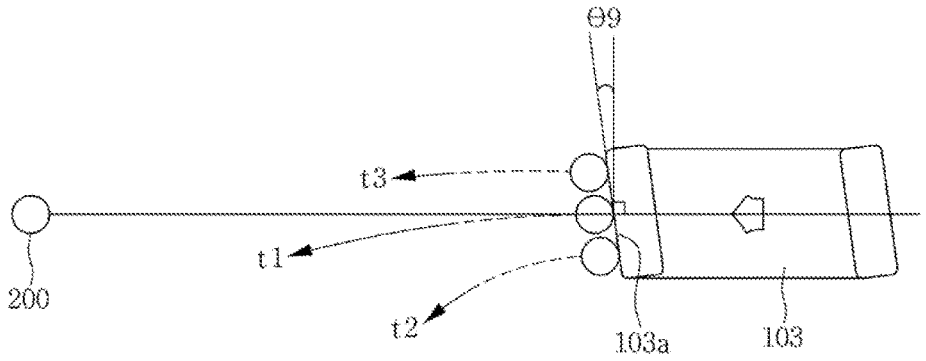
FIG. 16 is a view illustrating the moving traces of the golf ball at closed swing by use of a conventional typical putter.
Figure 17:
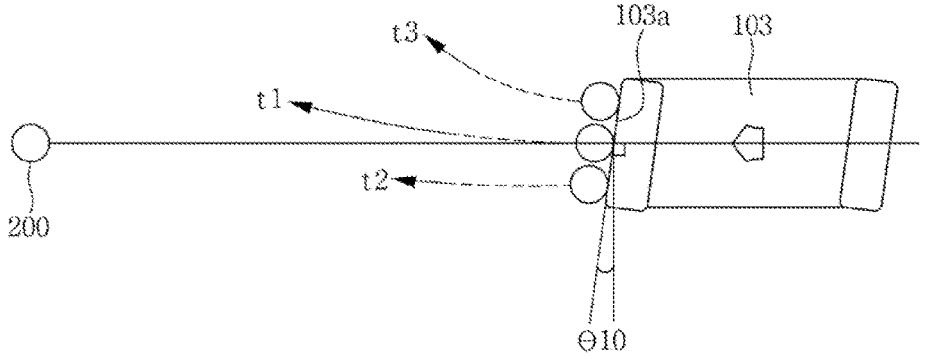
FIG. 17 is a view illustrating the moving traces of the golf ball at open swing by use of a conventional typical putter.
Figure 18:
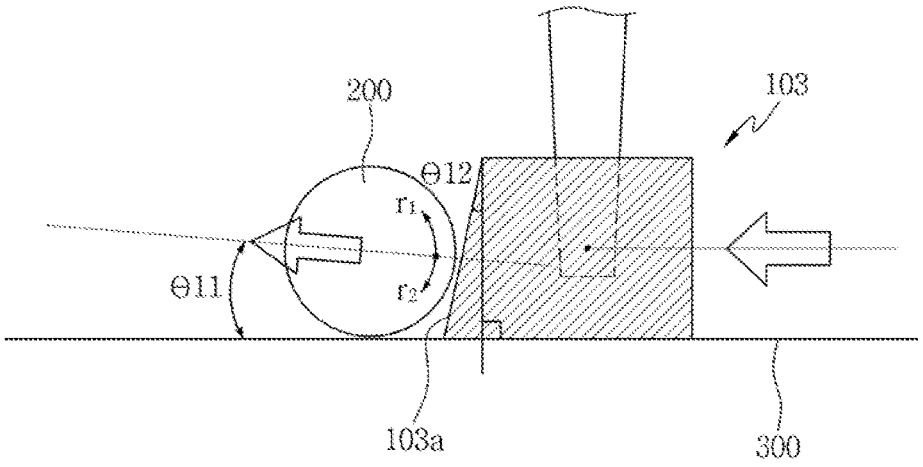
FIG. 18 is a view illustrating the moving state of the golf ball at putting by employing a normal camber in the use of a conventional typical putter.

Since exemplary embodiments of the present invention are provided only for structural and functional descriptions of the present invention, the present invention should not be construed as limited to the embodiments set forth herein. Thus, it will be clearly understood by those skilled in the art that the exemplary embodiments of the inventive concept may be embodied in different forms and include equivalents that can realize the spirit of the inventive concepts of the present invention. It should be understood, however, that it is not intended to limit the inventive concept to the particular forms disclosed, but on the contrary, the inventive concept is to cover all modifications, equivalents, and alternatives falling within the spirit and scope of the inventive concept as defined by the appended claims.

It will be understood that, although the terms first, second, etc. may be used herein to describe various elements, components, regions, and/or sections, these elements, components, regions, and/or sections should not be limited by these terms. These terms are only used to distinguish one element, component, region, layer or section from another region, layer or section. Thus, a first element, component, region, or section discussed below could be termed a second element, component, region, or section without departing from the teachings of the inventive concept.

It will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Meanwhile, spatially relative terms, such as "between" and "directly between" or "adjacent to" and "directly adjacent to" and the like, which are used herein for ease of description to describe one element or feature's relationship to another element(s) or feature(s) as illustrated in the figures, should be interpreted similarly.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless expressly defined in a specific order herein, respective steps described in the inventive concept may be performed otherwise. That is, the respective steps may be performed in a specified order, substantially at the same time, or in reverse order.

The present invention will now be described more fully hereinafter with reference to the accompanying drawings, in which exemplary embodiments of the inventive concept are shown.

Figure 19:
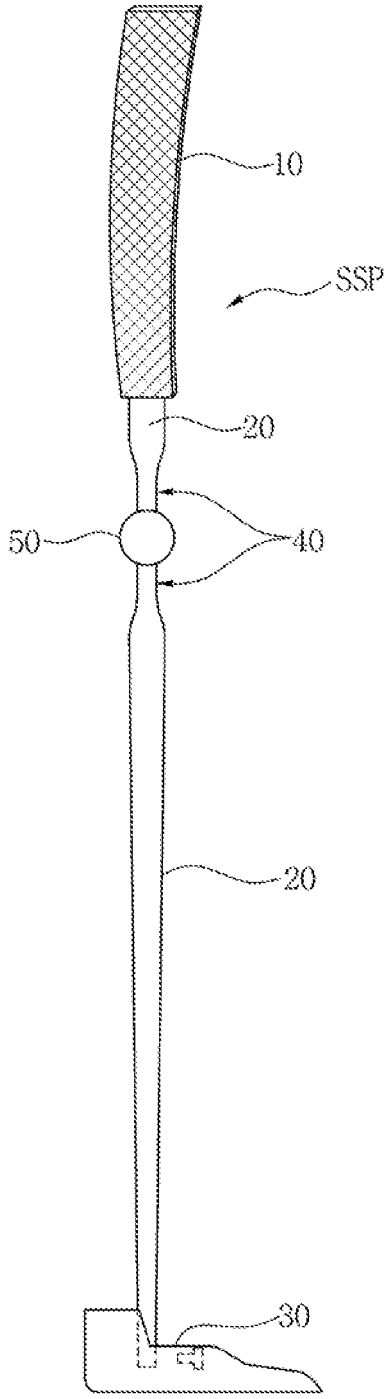
FIG. 19 is a side view of a side swing putter according to an embodiment of the present invention.
Figure 20:
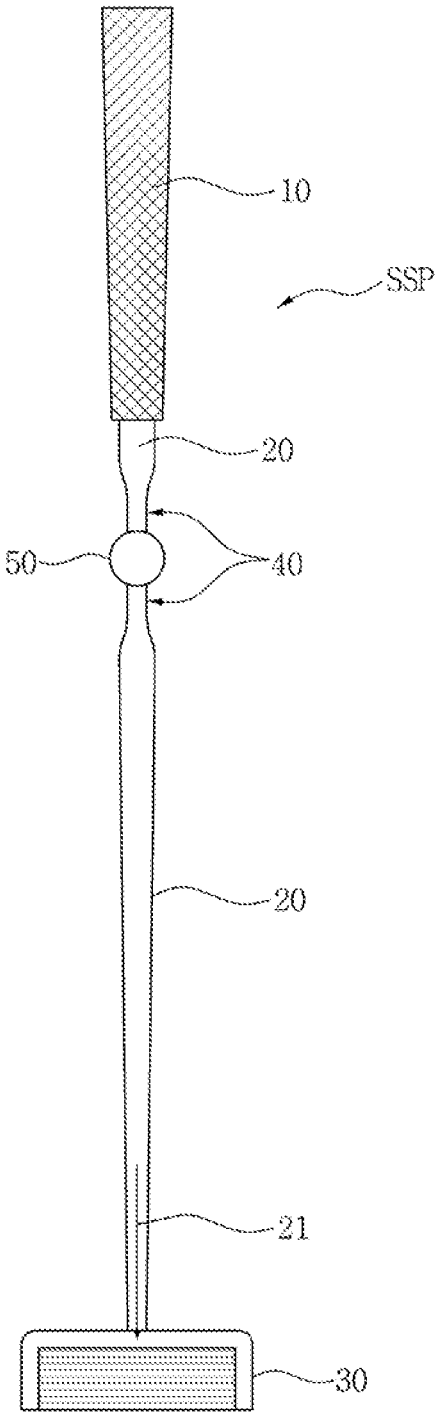
FIG. 20 is a front view of a side swing putter according to an embodiment of the present invention.
Figure 21:
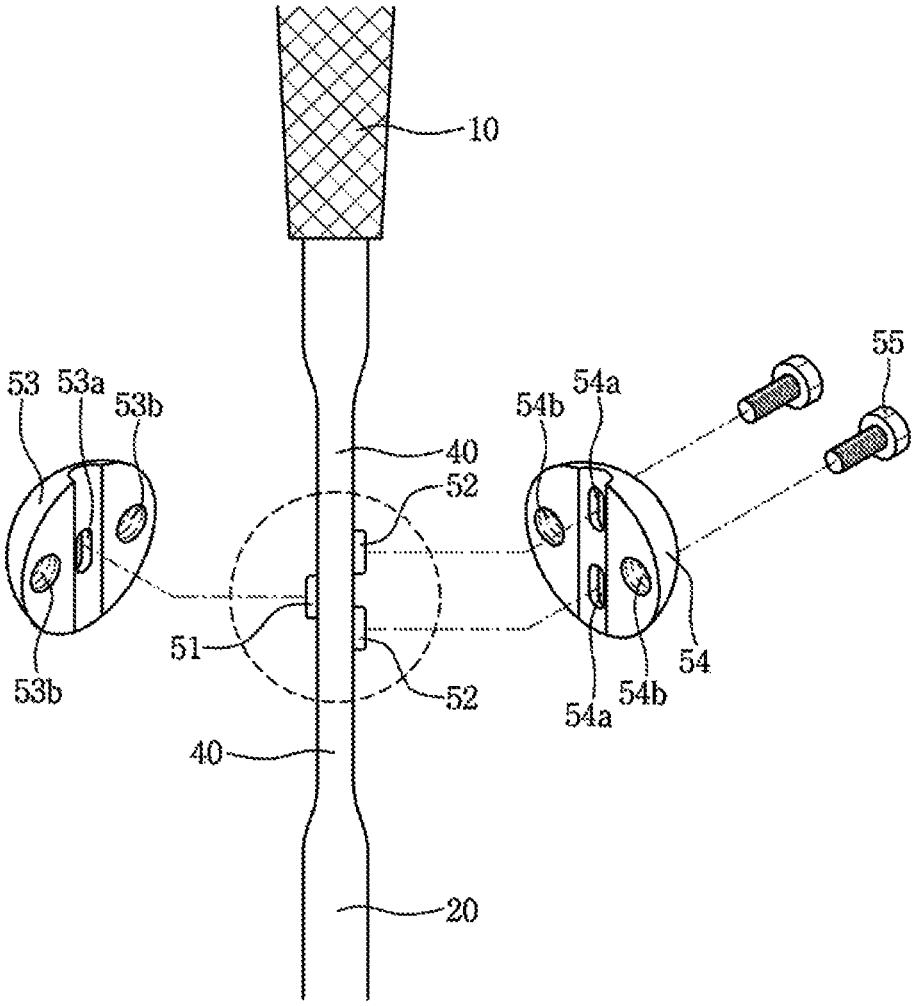
FIG. 21 is a disassembled view illustrating that a second grip is coupled to a shaft of a side swing putter according to an embodiment of the present invention.

FIG. 19 is a side view of a side swing putter according to an embodiment of the present invention, FIG. 20 is a front view of a side swing putter according to an embodiment of the present invention, and FIG. 21 is a disassembled view illustrating that a second grip is coupled to a shaft of a side swing putter according to an embodiment of the present invention.

Figure 22:
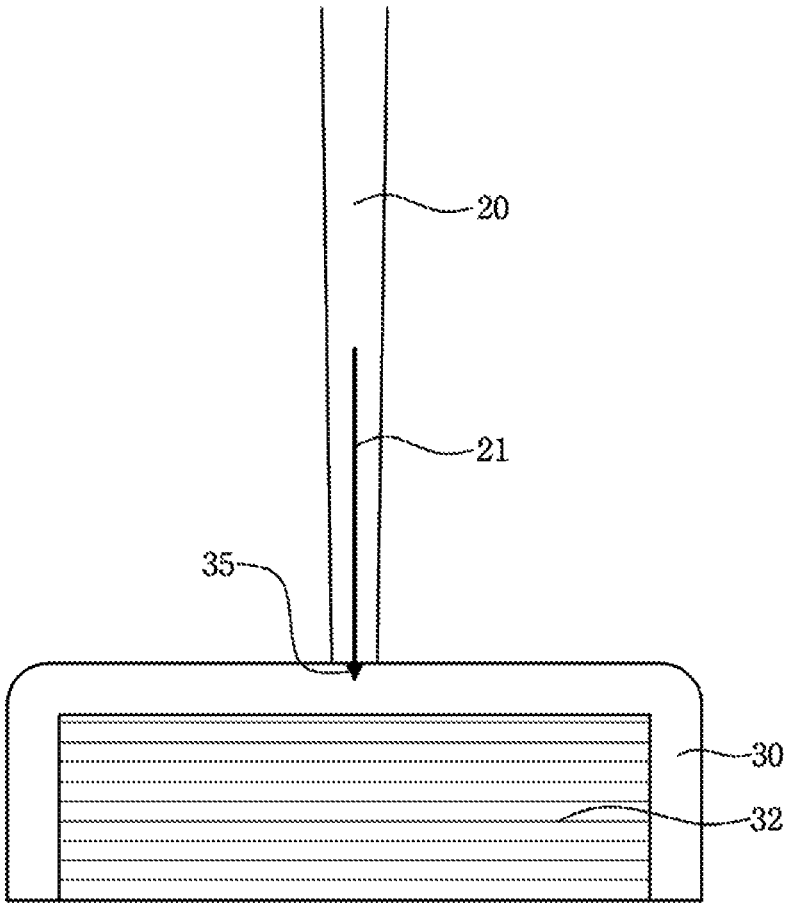
FIG. 22 is an enlarged front view schematically illustrating a head of a side swing putter according to an embodiment of the present invention.
Figure 23:
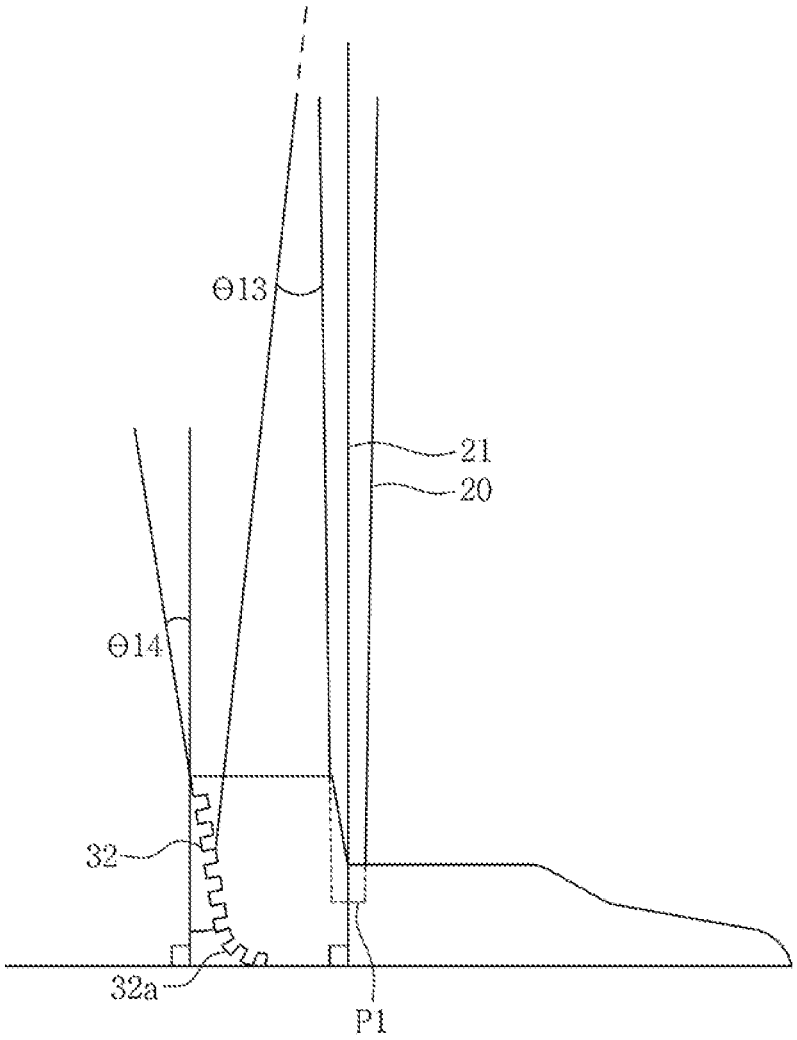
FIG. 23 is an enlarged side view illustrating a head of a side swing putter according to an embodiment of the present invention.
Figure 24:
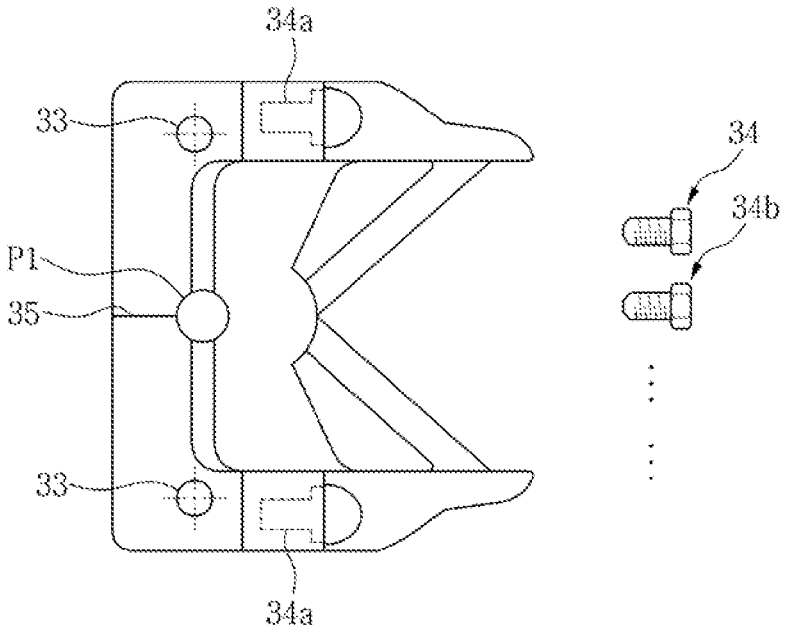
FIG. 24 is an enlarged plane view illustrating a head of a side swing putter according to an embodiment of the present invention.
Figure 25:
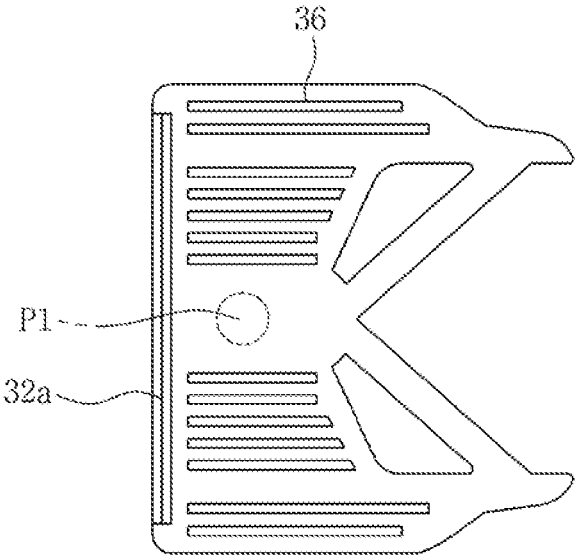
FIG. 25 is an enlarged bottom view illustrating a head of a side swing putter according to an embodiment of the present invention.

FIG. 22 is an enlarged front view schematically illustrating a head of a side swing putter according to an embodiment of the present invention, FIG. 23 is an enlarged side view illustrating a head of a side swing putter according to an embodiment of the present invention, FIG. 24 is an enlarged plane view illustrating a head of a side swing putter according to an embodiment of the present invention, and FIG. 25 is an enlarged bottom view illustrating a head of a side swing putter according to an embodiment of the present invention.

Referring to FIGS. 19 to 25, it will be explained in detail about the side swing putter (SSP) for golf ball putting while a golfer facing front and keep looking forward and putts a golf ball on the side of the ball according to an embodiment of the present invention, and hereinafter, the side swing putter (SSP) of the present invention may be noted as Look & Watching SSP. The SSP of the present invention is configured to add a second shaft 40 and a second grip 50 to a first grip 10, a first shaft 20, and a head 30, which are the components of a typical putter.

The second grip 50 is placed in the middle of the second shaft 40, and is configured for a golfer to be able to hold by his (or her) either one hand such that his palm of the hand is directed to face a first target direction. The first target direction means the direction which the hit ball is proceeding toward.

The first shaft 20 has the diameter equal to or close to that of the conventional golf putter. The first shaft 20 is located between the head 30 and the first grip 10, and specifically placed before and after the second shaft 40.

A second indicator line 21 is formed on the lower portion of the first shaft 20 as shown in FIGS. 20 to 22. The second indicator line 21 helps the golfer to see his swing accuracy visually when he swings a golf ball back and forth for putting on the side of a ball.

The head 30 is located at one end of the first shaft 20. On the putting surface of the head 30 is formed a reverse camber 31 having a predetermined angle (θ14) as illustrated in FIG. 23. The predetermined angle (θ14) of the reverse camber 31 is an inclined angle in the range of 1° to 3° with respect to a vertical line to produce top spin on the ball in order to enhance a straight-lined direction movement of the golf ball 200 being putted.

The predetermined angle of the reverse camber 31 may be very small, which is formed such that the upper portion of the putting surface of the head 30 is thick and the lower portion of the putting surface of the head 30 is thin.

As shown in FIGS. 23 to 25, a fixing point P1 is formed on the head 30 behind the putting surface of the head 30, and the first shaft 20 is fixedly positioned to the head 30 through the fixing point P1, which maintains a predetermined angle (θ13) with the head 30. As shown in FIGS. 22 and 23, a groove 32 shaped like multi steps in parallel are formed on the reverse camber 31 in order to produce top spin on the golf ball 200 by increasing its surface friction against the rotation direction of the golf ball 200 when a golfer swings and putts the golf ball 200 on the side of the ball.

The edge on the lower portion of the putting surface of the head 30 is made round in order to reduce putting errors which may occur by hit and impact on the edge of the head as illustrated in FIG. 23. An edge groove 32*a* is formed on the round-shaped edge of the putting surface of the head 30 with extended from the groove 32.

As shown in FIG. 24, weight distribution units 33 are formed on the back of the head 30 opposite to the putting surface of the head 30 having the groove 32 formed as multi steps in order to distribute its center of mass to both side ends of the head 30 and reduce the putting errors out of sweet spot. Also, the weight distribution as above helps for head swing perpendicularly (90°).

Further, an adjust weight 34 is formed on both side ends of the back portion of the head 30 in order to help correcting swing mistakes and to reduce the errors in swinging the putter to wrong direction incorrigibly and habitually.

The adjust weight 34 comprises a weight coupling part 34*a* formed on the back portion of the head 30, and adjust weight members 34 and 34*b* having different weight, for example, 12 g and 24 g, or screw of plastic dummy and selectively coupled with the weight coupling part 34*a*.

A first indicator line 35 is formed on the top surface of the head 30 as illustrated in FIG. 24 in order to visually guide a golfer the accuracy of the swing direction in training of swinging or in putting a golf ball in golf play games on the green. On the bottom surface of the head 30 are formed a plurality of blades 36 aligned in parallel with low height illustrated in FIG. 25 in order to reduce the friction of the head 30 with the top of the green grass in case that the head 30 of the putter comes to much contact with the grass on the green by swing mistakes, and in order to improve the direction of the ball travel as desired way of putting.

The second shaft 40 is located between the portions of the first shaft 20 below the first grip 10 and above the head 30 respectively, and formed to have a smaller diameter than that of the first shaft 20. The diameter of the second shaft 40 is in the range of φ5 mm to φ7 mm so that the second shaft 40 is inserted and held between forefinger and long finger or between long finger and fourth finger when the golfer holds and grips the second grip 50 having ball-shaped.

The side swing putter (SSP) of the present invention is shaped for a golfer to enable swing and putt a golf ball in more ease and with more comfortable position while he stands and keeps looking at the front toward the direction to a hit golf ball should proceed. Also, the second grip 50 is configured to have a ball shape as described above, which is easy for a golfer to enable hold the shaft of the putter and grip the second grip 50 more firmly with the palm of his one hand facing toward the direction of a target to which a putted ball should proceed and settle into, and enable keep watching and checking how the putted ball proceeds after swinging and putting.

The second grip 50 comprises a first stopper 51 formed on one side surface of the second shaft 40, and a plurality of second stoppers 52 formed on opposite the other side of the second shaft 40, a first hemisphere grip 53 having a first hole 53*a* which the first stopper 51 is fitted into, and a plurality of first nut insertion coupling holes 53*b*, a second hemisphere grip 54 positioning in opposite to the first hemisphere grip 53 and having a plurality of holes 54*a* which the second stoppers 52 are inserted into respectively and a plurality of coupling holes 54*b*, and fixing bolts 55 for coupling and fixing the two hemisphere grips 53 and 54 together when closely contact the first hemisphere grip 53 and the second hemisphere grip 54 together to the outer circumference surface of the second shaft 40 until to form a sphere shape and then, fix themselves to the second shaft 40 and be coupled to each other.

That is, the first hole 53*a* of the first hemisphere grip 53 is inserted into the first stopper 51 formed on one outer surface of the second shaft 40. The second holes 54*a* of the second hemisphere grip 54 are respectively inserted into the plurality of second stoppers 52 formed on the other opposite surface of the second shaft 40. The first hemisphere grip 53 and the second hemisphere grip 54 are placed to face each other having the second shaft 40 between them.

Then, a plurality of bolts 55 (or screws) are used to couple the two hemisphere grips 53 and 54 by inserting through the second coupling holes 54*b* of the second hemisphere grip 54 and the first nut insertion coupling holes 53*b* of the first hemisphere grip 53 having nuts inserted there inside. Thus, the ball-shaped second hemisphere grip 50 is fixed to the second shaft 40 and the coupling is completed.

Now, it will be described with reference to FIGS. 26 to 28 that the side swing putter (SSP) constructed as above according to an embodiment of the present invention allows a golfer to enable look at the target hole at front and while keeping the stance of looking at front, to enable putt the golf ball 200 to move in the same direction as he strikes the golf ball after he imagined the travel line of the golf ball previously (estimated trace of the golf ball). Also, the golfer can look at the front way and keep watching every trace of the golf ball moving toward the target hole at the same time of putting the golf ball 200 without turning his face sideway.

Figure 26:
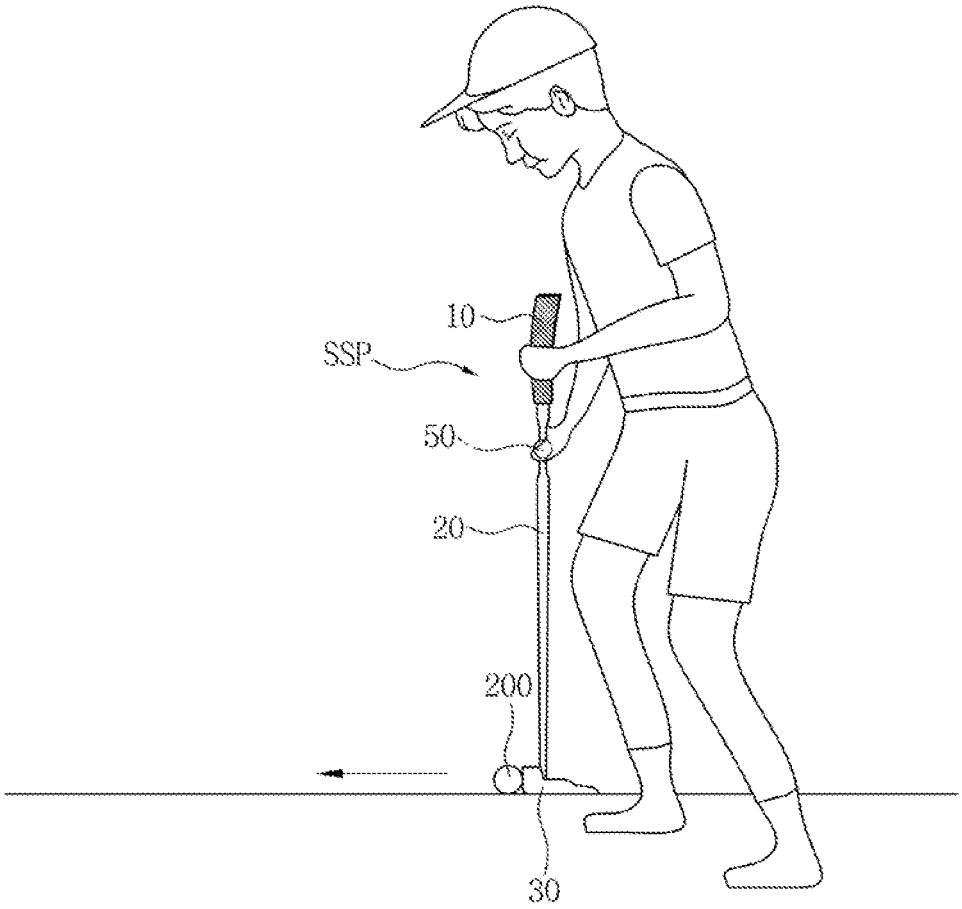
FIG. 26 is a schematic side view illustrating the swing posture of a golfer by use of a side swing putter according to an embodiment of the present invention.
Figure 27:
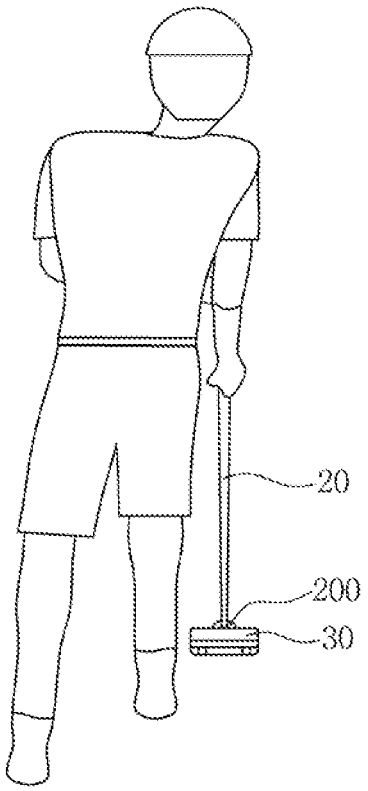
FIG. 27 is a schematic back view illustrating the swing posture of a golfer by use of a side swing putter according to an embodiment of the present invention.
Figure 28:
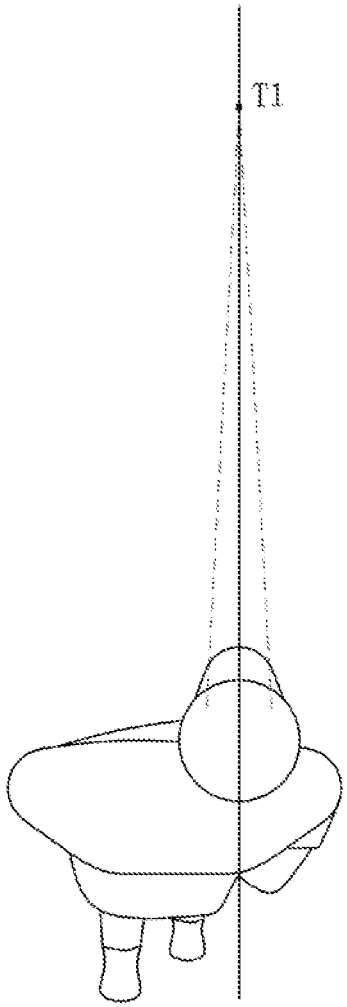
FIG. 28 is a schematic top view illustrating the swing posture of a golfer by use of a side swing putter according to an embodiment of the present invention.

As illustrated in FIGS. 26 to 28, a golfer grips the first grip 10 of the side swing putter (SSP) with one hand and grips the second grip 50 located below and having a ball shape with the other hand. Then, he looks at the putting line of the golf ball over the green at front, and swings the putter back and forth and putts the golf ball 200. Then, after the golf ball 200 is struck, a golfer can keep watching the golf ball 200 moving toward and the travelling trace of the golf ball as well as the moment that the golf ball 200 is putted and hit. Particularly, the side swing putter (SSP) of the present invention employing use of the first and the second grips 10 and 50 can be preferred for the case of very close distance of or less than 1 m or by the golfers who like typical traditional way of putting, in such a way that a golfer takes stance watching at front and also may strike a golf ball at the direction perpendicular to the first target direction by traditional grip, or cross-handed grip, or claw grip, etc. Therefore, both right-handed and left-handed golfers can use the side swing putter (SSP) of the present invention with the characteristics as above of the right and left symmetric feature.

When a golfer grips the first and the second grips 10 and 50, the parting line of the second grip 50 is made to be formed behind the central line of the sphere-shaped grip so that its front hemisphere part is protruded more than the second shaft 40 and the grip by the golfer's hand fingers can be more tighten with more force. Then, the central line of the second grip 50 comes to become the line identical reaching from the shoulder joint of the golfer and—the central line of the second grip 50—to the putting face of the sweet spot head 30 at the posture that the golfer sets his preparation for putting. Then, while the second grip 50 makes balance with the central line of the first shaft 20, the golfer can induce a top spin on the golf ball 200 through the head 30, during putting the golf ball 200.

Figure 29:
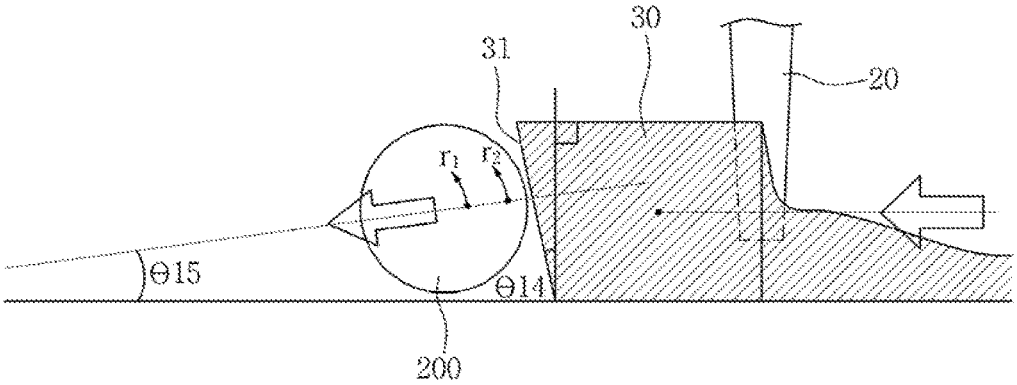
FIG. 29 is a view illustrating the moving state of the golf ball at putting by use of a side swing putter employing a reverse camber according to an embodiment of the present invention.

FIG. 23 is an enlarged side view schematically showing the head of the side swing putter (SSP) according to one embodiment of the present invention. A golfer swings the side swing putter (SSP) back and forth in which the side swing putter (SSP) has a reverse camber 31 on the putting surface of the head 30 and a predetermined angle θ14 as illustrated in FIG. 23. Then, when the golf ball 200 is putted, on the golf ball 200 is induced a top spin with an angle θ15 to enhance the straight-lined directional movement as illustrated in arrows r1 and r2 of FIG. 29. At the same time, top spin can be produced by the existence of the groove 32 formed on the reverse camber 31 by increasing the surface frictional force toward the rotation direction of the golf ball 200 as illustrated in FIG. 23.

As illustrated in FIGS. 22 and 23, the edge portion of the head 30 on the lower side of the putting surface is made to be round, and an edge groove 32*a* is formed on the round-shaped edge portion with extended from the groove 32. Then, the putting error induced from the edge strike similarly to the topping of an iron shot can be reduced by using the side swing putter (SSP) according to an embodiment of the present invention.

Here, the rounding on the edge portion of the lower side of the head 30 shall be preferably made radius of golf's swing back and forth, that is, the length from the shoulder of a golfer to the edge portion of the putting surface of the head 30. Further, several more kinds of rounding shape may be made depending on the standard body models of golfers.

FIGS. 24 and 25 are enlarged views of the head of the side swing putter (SSP) of the present invention. As illustrated in FIG. 24, weight distribution units 33 are formed on the head 30 to distribute its center of mass to both sides of the head 30. In addition, an adjust weight 34 is provided to help adjust the weight of the head 30 which is different at both sides of the head 30 in order to reduce the errors in swinging the putter from incorrigible habits depending on individuals. Adjust weight members 34*b* being different in weight from each other can be coupled into weight coupling parts 34*a* positioned at both rear sides of the head 30, the structure of which helps the golfer enable position the head 30 and swing perpendicular to the proceeding direction of the golf ball after putting. Thus, the putting errors occurred depending on the shoulder of the golfer being open or closed can be reduced and the errors of the putting results out of sweet spot can be minimized. That is, the errors of putting and swinging raised habitually and incorrigibly can be adjusted to the minute by the adjust weight elements as above.

Each of the adjust weight members 34*b* is different in weight from each other, and it may have a weight of, for example, 12 g, 24 g, and so on, and may be made as a screw of several types metal materials, according to one embodiment of the present invention. Any one weight of the adjust weight member 34*b* can be selected by several swinging practices. The determined metal material screw for the adjust weight member 34*b* with a determined weight can be selectively fit into the weight coupling part 34*a* on either of the left or right side on the rear surface of the head 30, so as to adjust the weight of the head 30. In the event that it is not necessary to adjust the weight of the head 30, a dummy screw being light in weight, its inside being empty, as the adjust weight member 34*b* may be fit into the weight coupling part 34*a*.

As illustrated FIGS. 20 and 22, a first indicator line 35 is formed on the front surface of the head 30 in the side swing putter (SSP) of the present invention as same as a second indicator line 21 is formed on the front portion of the first shaft 20 being connected to each other. These two straight lines on the top surface of the head 30 and the surface of the first shaft 20 assist a golfer to execute the putting more effectively during training or putting on the grass, so that he can swing the side swing putter (SSP) of the present invention back and forth while he keeps checking by his eyes weather his swinging is done along the right straight direction or not.

When a golfer strikes the golf ball 200 by swinging the side swing putter (SSP) back and forth, the blades 36 formed on the bottom of the head 30 helps to reduce the drag or the friction of the bottom surface of the head 30 with the top surface of the grass on the green and assists for the golfer to swing and putt to improve the straight-line movement in the event that the head 30 of the putter is dragged or make friction with the grass.

As described above, the look & watching side swing putter (SSP) according to the present invention was described with embodiments in detail referring to accompanied drawings. The embodiments are illustrative, but do not limit the concepts and spirits of the present invention.

In view of the foregoing, an embodiment of the side swing putter according to the present invention provides a putter which assists a golfer to enable watch and check his (or her) swinging and putting more easily and more correctly during practices or golf matches and results in him enable to execute better putting. The possibility of the hitted golf ball being skidded is further decreased and being rolled more correctly along the straight-lined direction toward the target is more increased. Also, it is induced for the golfer to correct his swinging posture which was fallen in habitual mistakes and putting errors so that the possibility that the head strikes the golf ball more accurately is further increased. Further, the side swing putter of the present invention brings up the effects of the golf ball forward directed in straight line enhanced with top spin even occurs in slight swing errors while eliminating the possibility of mistaken shot from wrong strikes on the bottom edges and extending the momentary contact time of the golf ball with the head putting surface. Also, the side swing putter of the present invention helps the straight line movement of the golf ball being putted while reducing the friction with green grass often occurred by putting mistakes and inducing the golfer to enable swing along more accurate direction.

The foregoing is illustrative of embodiments and is not to be construed as limiting thereof. Although a few embodiments have been described, those skilled in the art will readily appreciate that many modifications are possible without materially departing from the novel teachings and advantages. Accordingly, all such modifications are intended to be included within the scope of this present invention as defined in the claims. In the claims, means-plus-function clauses are intended to cover the structures described herein as performing the recited function, and not only structural equivalents but also equivalent structures.

What is claimed is:

1. A Side Swing Putter comprising:

a shaft, wherein the shaft is comprised of a first portion, a second portion, and a third portion from a bottom to a top of the shaft;

a first grip provided at a top end of the shaft;

a second grip is fitted with the second portion of the shaft and a golfer taking the second grip on by one hand with his or her palm facing a first target direction a head provided at a bottom end of the first portion of the shaft; and the second portion of the shaft extending up to the third portion of the shaft and down to the first portion of the shaft, and having a diameter configured to be inserted between the fingers of a golfer without irritating, wherein a diameter of the second portion of the shaft is slimmer than diameters of the first and the third portion of the shaft forming a slimmer portion and the diameters of the first and the second portions of the shaft are the same and, wherein the second grip forms a spherical shape being fitted on the slimmer portion.

2. The Side Swing Putter of claim 1, wherein the second portion of the shaft is configured to have a diameter in the range of 5 mm to 7 mm to be inserted between the index finger and long finger of the golfer's hand or between the long finger and the ring finger when the golfer takes a grip on the second grip having a sphere shape.

3. The Side Swing Putter of claim 1, wherein the head of the putter is configured such that the putting surface of the head has reverse camber of a predetermined angle.

4. The Side Swing Putter of claim 3, wherein the predetermined angle of the reverse camber is a reverse-incline angle in the range of 1° to 3° to the vertical line to produce top spin in order to improve the straight-lined direction movement of the golf ball being hit.

5. The Side Swing Putter of claim 3, wherein the head of the putter is configured such that the fixing point of the shaft to the head is located on a back of the putting surface of the head in order to increase an upward vector quantity of the head by pendulum movement, and grooves aligned in parallel are formed on the reverse camber of the putting surface of the head in order to reduce the slip of the golf ball, and in order to produce top spin by increasing the surface friction to the rotation direction of the golf ball.

6. The Side Swing Putter of claim 5, wherein a bottom edge portion of the putting surface of the head is made to have round shape in order to prevent the putting error raised by the blow Impact of the golf ball being hit to the head, and edge grooves are formed on the round-shaped edge portion of the putting surface of the head by extended from the grooves formed on the above.

7. The Side Swing Putter of claim 1, wherein the head is configured such that its center of mass is bidispersive along both ends back of the putting surface in order to reduce the errors from the hitting results out of sweet spot and reduce the occurrence of the head distorted at swing.

8. The Side Swing Putter of claim 1, wherein the head is configured such that an adjust weight is formed on both back sides of the head in order to adjust the error factors in the right and the left direction raised from individual variation of putting and improve the straight-lined directional movement.

9. The Side Swing Putter of claim 8, wherein the adjust weight comprises: weight coupling parts formed on both back sides of the head; and adjust weight members having different weights respectively and being able to be selectively coupled to the weight coupling parts.

10. The Side Swing Putter of claim 1, wherein a first indicator line is formed on a top surface of the head along its center line in order to help a golfer visually enable a his or her swinging back and forth accurately along the straight line, and a second indicator line is formed on a lower portion of the first portion of the shaft to be extended from and connected with the first indicator line to secure good visual views.

11. The Side Swing Putter of claim 1, wherein the head is configured such that a plurality of blades are formed on the bottom surface of the head along the putting direction in order to reduce the friction with green grass occurred when the head contacts and drags at putting and assist the straight movement of the golf ball being hit.

12. The Side Swing Putter of claim 1, wherein the second grip comprises:

a first stopper formed on an outside surface of one side of the second portion of the shaft;

a plurality of second stoppers formed on an outside surface of the other side of the second portion of the shaft;

a first hemisphere grip having a first hole, the first stopper being fitted into, and a plurality of nut insertion coupling holes;

a second hemisphere grip having a plurality of second holes, the second stoppers being fitted into, and a plurality of second coupling holes, the second hemisphere grip faced with the first hemisphere grip; and bolts/screws for fixing the first hemisphere grip and the second hemisphere grip to an outer circumference surface of the second portion of the shaft to form the spherical shape and coupling the first and second hemisphere grips together.

* * * * *